US008525424B2

(12) United States Patent
Li et al.

(10) Patent No.: US 8,525,424 B2
(45) Date of Patent: Sep. 3, 2013

(54) CIRCUITRY AND METHOD FOR DRIVING LED DISPLAY

(75) Inventors: Eric Li, Milpitas, CA (US); Chun Lu, San Jose, CA (US)

(73) Assignee: SCT Technology, Ltd., Grand Cayman (KY)

( * ) Notice: Subject to any disclaimer, the term of this patent is extended or adjusted under 35 U.S.C. 154(b) by 121 days.

(21) Appl. No.: 13/311,035

(22) Filed: Dec. 5, 2011

(65) Prior Publication Data

US 2013/0140998 A1 Jun. 6, 2013

(51) Int. Cl.
*G09G 3/36* (2006.01)

(52) U.S. Cl.
USPC ..... 315/187; 315/247; 345/82; 345/84

(58) Field of Classification Search
None
See application file for complete search history.

(56) References Cited

U.S. PATENT DOCUMENTS

| | | | | |
|---|---|---|---|---|
| 5,552,677 | A * | 9/1996 | Pagones | 315/169.1 |
| 7,126,568 | B2 * | 10/2006 | LeChevalier | 345/84 |
| 7,277,073 | B2 * | 10/2007 | Hattori | 345/77 |
| 7,446,744 | B2 * | 11/2008 | Klein et al. | 345/87 |
| 8,334,660 | B2 * | 12/2012 | Li et al. | 315/291 |

* cited by examiner

*Primary Examiner* — Shawki Ismail
*Assistant Examiner* — Nelson Correa
(74) *Attorney, Agent, or Firm* — Novick, Kim & Lee, PLLC; Allen Xue

(57) ABSTRACT

This disclosure provides a circuit and a method for driving an LED display. The driving circuit comprises a selection circuit for selecting a first light emitter from the plurality of light emitters, a pre-charging circuit for charging an equivalent capacitor of the display panel with respect to the selected first light emitter, and a power circuit for supplying power to the first light emitter after the first light emitter is selected, wherein the power circuit is configured to supply a driving current to the first light emitter in one or more stages. The driving circuit and method of this disclosure can be used to significantly increase the refresh rate and resolution of the LED display.

20 Claims, 3 Drawing Sheets

CIRCUITRY AND METHOD FOR DRIVING LED DISPLAY

TECHNICAL FIELD

The present disclosure relates generally to devices and methods used for light emitting diode (LED) displays, and more particularly to circuitries and methods for driving the LED display.

BACKGROUND

A time-multiplexing LED matrix display comprises one or more arrays of LEDs. One of the performance characteristics of a LED matrix display is the time it takes for an LED to light up when its select signal turns on. Since the components in an LED matrix display have capacitance that needs to be charged before the LED becomes lit, the time delay could be significant.

FIG. 1 shows a generalized form of LED array in a time-multiplexing LED matrix display. The LEDs are arranged in an N by M fashion, with M channels (columns) of current source intersecting with N scan lines (rows). At any given time, there may be zero to M channels being supplied with a current while only one scan line being selected for any current channel. In order to light an LED at the intersection of column i and row j (i.e., LED 111 in FIG. 1), the current source has to charge all the capacitors on the N by M array affecting this LED. For LED 111, such capacitors include the wire capacitor $C_W$ 100, capacitor $C_L$ for each of the LEDs in column i 101, . . . , 10N, and switch capacitor $C_S$ for each of the switches 121 to 12N, excluding 12*j*.

The effect of all the capacitors can be presented as an equivalent capacitor $C_i$ for LED(i,j). For illustrative purposes, assuming the capacitance for all the LEDs ($C_L$) are identical and the capacitance for all the switches ($C_S$) are identical, $C_i$ can be expressed as follows:

$$C_i=C_W+C_L+(N-1)*C_S*C_L/(C_S+C_L)$$

LEDs arranged in manners other than those in FIG. 1 would have similar time delays since the components (e.g., the LEDs, wires, switches) have capacitance. The present disclosure provides devices and means to shorten the time delay caused by charging the affecting capacitors.

SUMMARY OF INVENTION

The current disclosure provides a circuit for driving an LED display panel including a plurality of light emitters being arranged in an array having a plurality of columns and rows. The driving circuit is electrically coupled with the array of the light emitters. The driving circuit comprises a selection circuit for selecting a first light emitter from the plurality of light emitters, a pre-charging circuit for charging an equivalent capacitor of the display panel with respect to the selected first light emitter, and a power circuit for supplying power to the first light emitter after the first light emitter is selected. The power circuit comprises a power source, and a current control mechanism coupled with the power source. The current control mechanism is configured to supply a first current to the power source when a driving current through the first light emitter is less than or equal to a first threshold value. The current control mechanism is also configured to supply a second current to the power source when the driving current is greater than the first threshold value and less than a second threshold value. The first current is greater than the second current.

In one embodiment, the pre-charging circuit comprises a first transistor, a first switch electrically coupled with the first transistor, and first logic gate electrically coupled with the first switch. The logic gate comprises an AND gate.

In one embodiment, the power circuit comprises second logic gate, a second transistor electrically coupled with the second logic gate, a second switch electrically coupled with the second transistor, a first resistor, and a second resistor, wherein the second switch is switchable among the first and second resistors.

The current disclosure also provides a method for driving a display panel including an array of light emitters. The method comprises charging an equivalent capacitor of the array before a first light emitter is selected from the array of light emitters and after a previously selected light emitter is unselected, selecting the first light emitter, and applying a driving voltage to the first light emitter using a power source after the first light emitter is selected, so as to induce a driving current through the first light emitter, wherein applying the driving voltage comprises, when the driving current is less than or equal to a first threshold value, applying a first current to the power source, so as to quickly turn on the power source, and when the driving current is greater than the first threshold value and less than a second threshold value, applying a second current to the power source, so as to minimize current overshoot , wherein the first current is greater than the second current.

DESCRIPTIONS OF DRAWINGS

The teachings of the present disclosure can be readily understood by considering the following detailed description in conjunction with the accompanying drawings.

DETAILED DESCRIPTION OF THE EMBODIMENT

The Figures (FIG.) and the following description relate to the embodiments of the present disclosure by way of illustration only. It should be noted that from the following discussion, alternative embodiments of the structures and methods disclosed herein will be readily recognized as viable alternatives that may be employed without departing from the principles of the claimed inventions.

Reference will now be made in detail to several embodiments of the present disclosure(s), examples of which are illustrated in the accompanying figures. It is noted that wherever practicable similar or like reference numbers may be used in the figures and may indicate similar or like functionality. The figures depict embodiments of the present disclosure for purposes of illustration only. One skilled in the art will readily recognize from the following description that alternative embodiments of the structures and methods illustrated herein may be employed without departing from the principles of the disclosure described herein.

Figure 1:
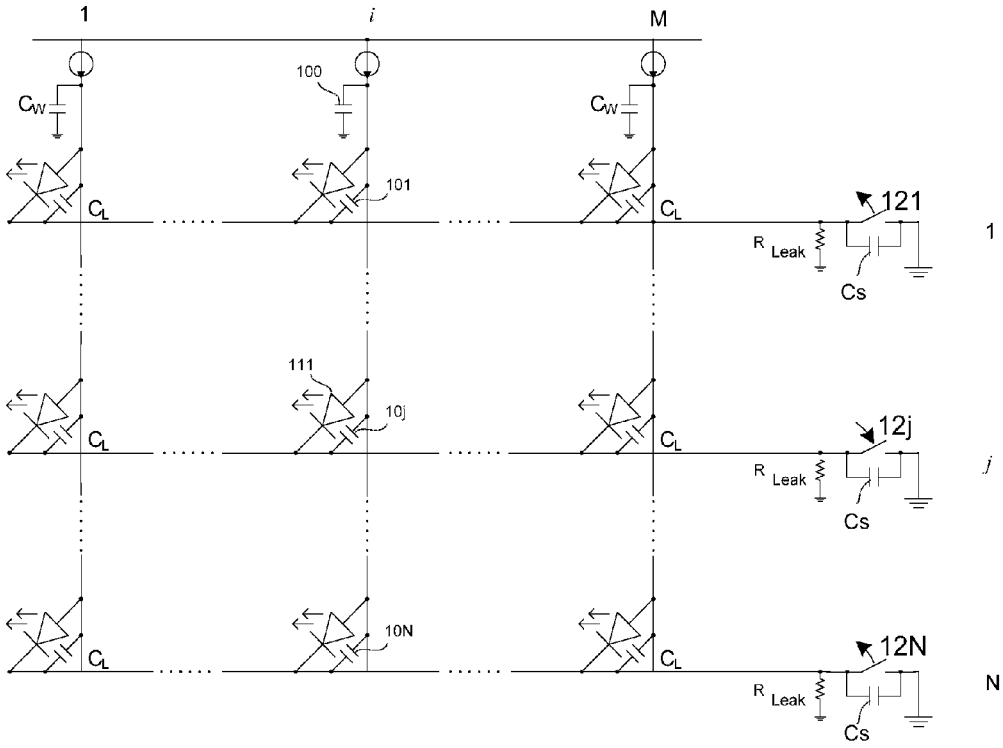
FIG. 1 is a diagram of an LED array.
Figure 2:
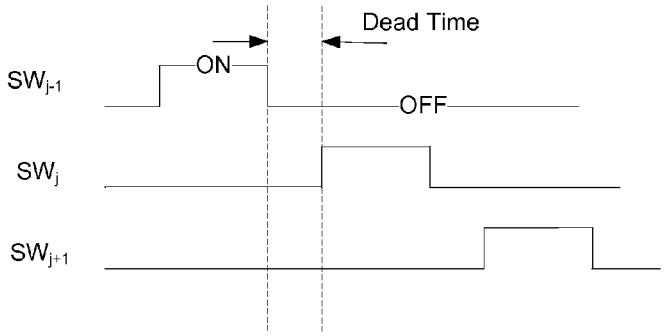
FIG. 2 is a timing diagram for scan line driving signals.

FIG. 2 shows a timing diagram of scan line switch selection. $SW_j$ denotes an active high signal of scan line j selection when the switch at row j is turned ON. There is a short period of time between two consecutive active high signals. This time gap is called dead time.

Figure 3:
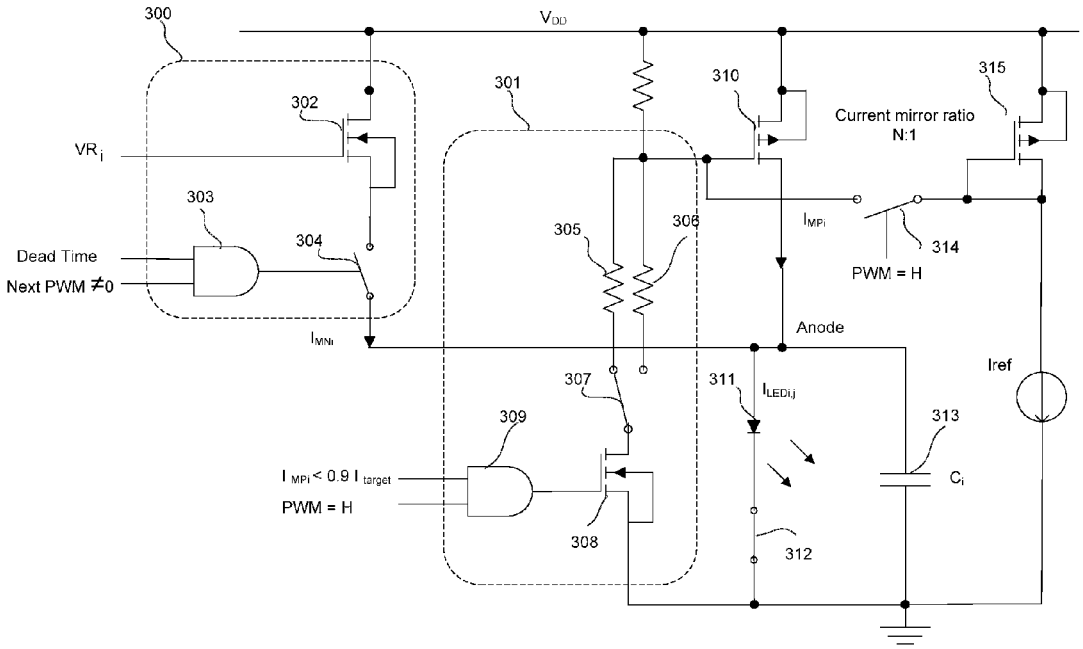
FIG. 3 is a circuit according to one embodiment of the current disclosure.

FIG. 3 is an operation diagram of an LED fast rising driver circuit of the present disclosure. Component 313 represents the equivalent capacitor load described above.

According to one embodiment of the current disclosure, the fast rising driver circuit comprises two modules 300 and 301. Module 300 comprises an NMOS 302, an AND gate 303 and a switch 304. It connects the logic "1" voltage, POWER or VDD, at one end and the anode of LED 311 at the other end.

Module 300 has three inputs—$VR_i$, a dead time signal, and a signal for "Next PWM not equal to 0". $VR_i$ is a reference voltage specifically set for LED 311. The dead time signal is a logic signal deducted or derived from $SW_j$ as shown in FIG. 2. It is only active between two sequential active select signals $SW_j$. The third signal "Next PWM not equal to 0" is a logic signal deducted or derived from the PWM (pulse width modulation) signal. A more detailed description about the PWM signal can be found in U.S. application Ser. No. 13/237,960, filed Sep. 21, 2011, which is incorporated herein by reference in its entirety. The "Next PWM not equal to 0" signal is only active when the next PWM signal is not equal to logic zero.

In one embodiment, Module 300 takes effect during dead time. Switch 312 is OFF during dead time so that no current flows through LED 311. On the other hand, if the two signals at gate 303 become true and drive the gate 303 to output a true signal, the switch 304 is turned ON. $VR_i$ is set at a value so that the current through NMOS 302 charges the capacitor 313 and pull up the LED anode side voltage to slightly lower than $VF_0$. That is, the value of ($VR_i$−Vth) is slightly lower than the LED inflection voltage $VF_0$. Vth is the threshold voltage of NMOS 302, while $VF_0$ equals the forwarding voltage at the inflection point of the LED. The value of $VF_0$ for a red LED ranges from, for example, 1.6V to 2.6V. The value of $VF_0$ for a green or blue LED ranges from, for example, 2.6V to 3.8V.

NMOS 302 becomes ON when switch 304 is ON. This allows the current to flow from VDD through NMOS 302 to charge the capacitive load of the LED display, represented by the equivalent capacitor 313. Module 300 stops contributing voltage or current after the dead time is over as gate 303 outputs false and switch 304 is turned OFF.

Figure 4:
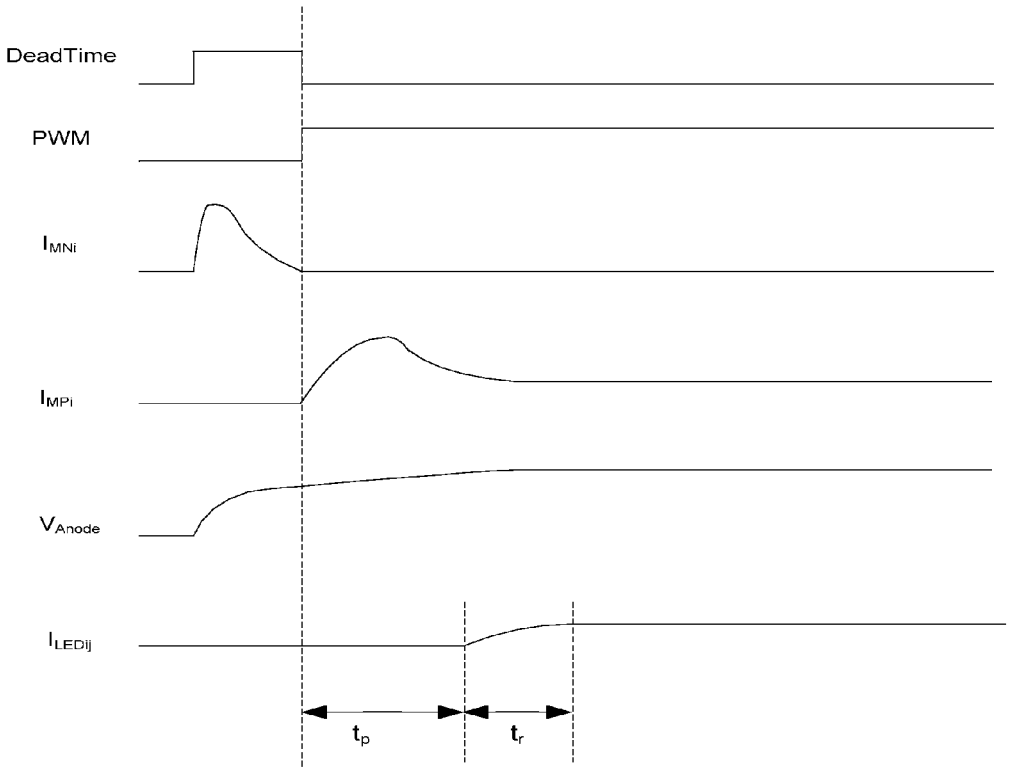
FIG. 4 is a diagram illustrating the behaviors of various signals in one embodiment of the current disclosure.

Accordingly, the anode side voltage is raised to a value close to but less than the LED $VF_0$ during the dead time by the operation of Module 300. For example, the anode side voltage can be raised to a value that is 0.2V or less below $VF_0$. Consequently, when the next PWM selection cycle comes, the time it takes to charge the capacitor 313 to the LED $VF_0$ is short. As shown in FIG. 4, the current through NMOS 302 ($I_{MNi}$) quickly increases after the dead time starts, while $V_{Anode}$ also rises, approaching $VF_0$.

Module 301 takes effect after the dead time is over. Module 301 comprises two resistors 305 and 306, a switch 307, an NMOS 308, and an AND gate 309. One end of Module 301 connects to the gate input of PMOS 310 and the other end connects to the logic "0", GROUND or VSS. There are two logic signal inputs to the AND gate 309, one is "PWM equals high" and the other is related to $I_{MPi}$. The logic signal "PWM equals high" is deducted or derived from the PWM signal for chancel i. It becomes high when the PWM signal becomes high and it becomes low when the PWM signal becomes low. The other logic signal becomes high when the LED current $I_{MPi}$ from PMOS 310 is less than a threshold value. This threshold value can be set at any value between 0 and the target LED current, for example, between 30% to 98%, or between 50% to 95%, or between 75% to 95%, or between 85% to 95% of the target LED current. In the embodiment of FIG. 3, this threshold value is set at 90%. In some embodiments, the target LED current is the electrical current through an LED such that the LED can emit light of the maximum possible intensity without damaging the LED.

Accordingly, Module 301 operates when the PWM signal is high and when the LED current $I_{MPi}$ from PMOS 310 is less than 90% of the target LED current value. In such instances, the AND gate 309 outputs a logical true signal to the gate input at NMOS 308. This gate input turns NMOS 308 ON, which in turn pulls down the gate voltage of PMOS 310 to turn it ON. Once PMOS 310 is ON, the current source starts driving current to LED 311 and charging the capacitor 313.

As shown in FIG. 4, the voltage at the LED anode side, $V_{Anode}$, begins to rise during the dead time and continues to rise after the dead time, as the capacitor 313 is being charged by the operation of Module 301. When the $V_{Anode}$ exceeds $VF_0$, LED 311 starts to have current. The LED current ($I_{LEDij}$) continues to rise gradually until it reaches a steady level—the target LED current, e.g., at 5 mA. "$t_p$" is the time from when PWM turns high to when LED 311 starts to have a current. During the time of $t_p$, there is no current going through the LED. "$t_r$" is the time it takes for the LED current to rise from one value to another, e.g., from just above zero to 90% of the target LED current in this embodiment.

In the embodiment shown in FIG. 3, Module 301 further uses two resistors 305 and 306 to minimize current overshoot. When $I_{MPi}$ is zero, the smaller resistor 305 is used to allow a bigger current to pull down the gate input of PMOS 310. When $I_{MPi}$ is larger than zero but less than 90% of the target LED current, the bigger resistor 306 is selected by switching switch 307, which lowers the current and thus limits the current overshoot at PMOS 310. When the $I_{MPi}$, is larger than 90% of the target LED current, none of the resistors is selected. Instead, a mirror current source, which comprises a reference current source ($I_{ref}$) and PMOS 315, maintains the PMOS 310 output current substantially at the target LED current, for example, within ±3% of the target LED current. Note that switch 314 is OFF when PWM is high, disconnecting the mirror current source from PMOS 310.

Therefore, the embodiment shown in FIG. 3 uses two stages of charging: the first stage when the LED current is zero and the second stage when the LED current is larger than zero but less than 90% of the target value. In another embodiment, a single stage of charging may be employed when the LED current ranges from zero to 100% of its target value, for example, by implementing only one or none of the resistors 305 and 306. In still other embodiments of this disclosure, more than two stages of charging may be implemented by adding additional charging stages when the LED current is between zero and the target value. For example, adding one charging stage at each current range when the LED current is between zero to 30%, between 30% to 60%, and between 60% to 90% of the LED target current results in a total four charging stages. The number of AND gates and resistors used in Module 301 should increase accordingly.

When the PWM signal becomes low and gate 309 output is low, NMOS 308 turns OFF. There is no current to the gate input for PMOS 310. The gate input of PMOS 310 is then pulled close to VDD. This keeps PMOS 310 OFF and no current will reach the anode side of LED 311 through PMOS 310.

Therefore, embodiments of driver design disclosed herein allow the voltage at the anode side of LED 311 to be pre-charged to close to $VF_0$ by the operation of Module 300; so that after the PWM signal goes high, it can be quickly charged to $VF_0$. As shown in FIG. 4, $t_p$ is much shorter than the normal charge time when the capacitor is charged from ground up to $VF_0$. Furthermore, Module 301 acts to pull down the gate voltage of PMOS 310 quickly, which reduces the value of $t_r$. As a result, the total of $t_p$ and $t_r$ is short, for example, less than 10 ns.

In some embodiments of the current disclosure, the time period of pre-charging may be longer or shorter than the dead time. The start or finish of the pre-charging period may not be aligned with the start or finish of the dead time. Signals other than those derived from PMW or the dead time signal may be used to initiate or terminate the pre-charging period.

The methods and circuits disclosed herein can be used to drive LEDs arranged in a common anode or in a common cathode fashion, which are described in more details in pending U.S. application Ser. No. 13/237,960. They can also be used, for example, in the fast charge circuits 304, 305, and 306 as disclosed in U.S. application Ser. No. 13/237,960.

Many modifications and other embodiments of the disclosure will come to the mind of one skilled in the art having the benefit of the teaching presented in the forgoing descriptions and the associated drawings. For example, the driver IC can be used to drive an LED array in either common cathode or common anode configuration. Elements in the LED array can be single color LEDs or RGB units or any other forms of LEDs available. The driver IC can be scaled up or scaled down to drive LED arrays of various sizes. Multiple driver ICs may be employed to drive a plurality of LED arrays in a LED display system. The components in the driver can either be integrated on a single chip or on more than one chip or on the PCB board. Such variations are within the scope of this disclosure. It is to be understood that the disclosure is not to be limited to the specific embodiments disclosed, and that the modifications and embodiments are intended to be included within the scope of the dependent claims.

What is claimed is:

1. A display panel, comprising:

a plurality of light emitters arranged; and a driving circuit electrically coupled with the plurality of light emitters;

wherein the driving circuit comprises:

a selection circuit for selecting a first light emitter from the plurality of light emitters;

a pre-charging circuit for charging an equivalent capacitor of the display panel with respect to the selected first light emitter; and a power circuit for supplying power to the first light emitter after the first light emitter is selected, wherein the power circuit comprises a power source, and a current control mechanism coupled with the power source, wherein the current control mechanism is configured to supply a first current to the power source, when a driving current through the first light emitter is less than or equal to a first threshold value, and wherein the current control mechanism is configured to supply a second current to the power source, when the driving current is greater than the first threshold value and less than a second threshold value, wherein the first current is greater than the second current.

2. The display panel of claim 1, wherein the pre-charging circuit operates during dead time, which is a time period before the first light emitter is selected and after a previously selected light emitter is unselected.

3. The display panel of claim 1, wherein the pre-charging circuit comprises a first transistor, a first switch electrically coupled with the first transistor, and a first logic gate electrically coupled with the first switch.

4. The display panel of claim 3, wherein the first transistor comprises an NMOS device, and the first logic gate comprises an AND logic gate.

5. The display panel of claim 1, wherein the current control mechanism comprises a second logic gate, a second transistor electrically coupled with the second logic gate, a first resistor, a second resistor, and a second switch electrically coupled with the second transistor, the second switch being switchable among the first and second resistors.

6. The display panel of claim 5, wherein the second logic gate comprises an AND logic gate and the second transistor comprises an NMOS device.

7. The display panel of claim 5, wherein the second resistor has a resistance greater than that of the first resistor.

8. The display panel of claim 7, wherein the second switch is switched to the first resistor when the driving current is less than or equal to the first threshold value so as to supply the first current, and wherein the second switch is switched to the second resistor when the driving current is between the first threshold value and the second threshold value so as to supply the second current.

9. The display panel of claim 8, wherein the first threshold value is zero and the second threshold value is about 90% of a target driving current.

10. The display panel of claim 9, wherein the power circuit further comprises a current mirror for maintaining the driving current through the first light emitter to be substantially equal to the target driving current.

11. An apparatus for driving an array of light emitters, comprising:

a selection circuit for selecting a first light emitter from the array of light emitters;

a pre-charging circuit for charging an equivalent capacitor of the array with respect to the selected first light emitter; and a power circuit for supplying power to the first light emitter after the first light emitter is selected, wherein the power circuit comprises a power source and an current control mechanism coupled with the power source, wherein the current control mechanism is configured to supply a first current to the power source, when a driving current through the first light emitter is less than or equal to a first threshold value, and wherein the current control mechanism is configured to supply a second current to the power source, when the driving current is greater than the first threshold value and less than a second threshold value, wherein the first current is greater than the second current.

12. The apparatus of claim 11, wherein the pre-charging circuit operates during the dead time, which is a time period before the first light emitter is selected and after a previously selected light emitter is unselected.

13. The apparatus of claim 11, wherein the pre-charging circuit comprises a first transistor, a first switch electrically coupled with the first transistor, and first logic gate electrically coupled with the first switch.

14. The apparatus of claim 11, wherein the current control mechanism comprises a second logic gate, a second transistor electrically coupled with the second logic gate, a second switch electrically coupled with the second transistor, a first resistor, and a second resistor, wherein the second switch is switchable among the first and second resistors.

15. The apparatus of claim 14, wherein the second resistor has a resistance substantially greater than that of the first resistor.

16. The apparatus of claim 15, wherein the second switch is switched to the first resistor when the driving current is less than or equal to the first threshold value so as to supply the first current, and wherein the second switch is switched to the second resistor when the driving current is between the first threshold value and the second threshold value so as to supply the second current.

17. The apparatus of claim 16, wherein the first threshold value is zero and the second threshold value is about 90% of a target value of the driving current for driving the first light emitter.

18. The apparatus of claim 17, wherein the power circuit further comprises a current mirror for maintaining the driving current through the first light emitter to be substantially equal to the target driving current.

19. A method for driving a display panel including an array of light emitters, the method comprising:

charging an equivalent capacitor of the array before a first light emitter is selected from the array of light emitters and after a previously selected light emitter is unselected;

selecting the first light emitter; and applying a driving voltage to the first light emitter using a power source after the first light emitter is selected, so as to induce a driving current through the first light emitter, wherein applying the driving current further comprises:

when the driving current is less than or equal to a first threshold value, applying a first current to the power source, and when the driving current is greater than the first threshold value and less than a second threshold value, applying a second current to the power source, wherein the first current is greater than the second current.

20. The method of claim 19, wherein the first threshold value is zero and the second threshold value is about 90% of a targeted current for driving the first light emitter.

* * * * *